United States Patent [19]

Gauchard

[11] 3,964,140

[45] June 22, 1976

[54] COFFIN

[76] Inventor: Fernand Gauchard, Parc du Beau, Santeny (Val-de-Marne), France

[22] Filed: Nov. 26, 1974

[21] Appl. No.: 527,294

[30] Foreign Application Priority Data

Nov. 26, 1973 France ..... 73.41952

[52] U.S. Cl. ..... 27/2; 27/11; 27/35

[51] Int. Cl.[2] ..... A61G 17/00

[58] Field of Search ..... 27/1–8, 27/11, 19, 35

[56] References Cited

UNITED STATES PATENTS

| | | | |
|---|---|---|---|
| 167,451 | 9/1875 | Hunt | 27/11 |
| 188,014 | 3/1877 | Holmes | 27/11 |
| 729,921 | 6/1903 | Duncan | 27/7 |
| 818,220 | 4/1906 | Belair | 27/11 |
| 1,150,688 | 8/1915 | Maggia | 27/11 |
| 1,503,958 | 8/1924 | McCampbell | 27/11 |
| 2,247,617 | 7/1941 | Metz | 27/35 |
| 2,848,780 | 8/1958 | Gosnell | 27/7 |
| 2,911,988 | 11/1959 | Ravn | 27/11 |
| 3,545,055 | 12/1970 | Pare | 27/7 |

FOREIGN PATENTS OR APPLICATIONS

| | | | |
|---|---|---|---|
| 1,406,023 | 6/1965 | France | 27/2 |
| 2,957 | 11/1862 | United Kingdom | 27/2 |

*Primary Examiner*—John D. Yasko
*Attorney, Agent, or Firm*—Young & Thompson

[57] ABSTRACT

A coffin has at its bottom two parellel corrugated sheets which are spaced apart from each other and also spaced above and parallel to the bottom of the coffin. Cellulose wool or sawdust is disposed between the sheets, which are perforated for the passage of body fluids therethrough and may also contain activated charcoal or silica gel between them. In the space below the sheets there is disposed a solid bactericidal material such as permanganate- or formaldehyde-containing material or material releasing bromine, chlorine or iodine. A drain may also be provided at the level of the bottom of the the coffin.

2 Claims, 2 Drawing Figures

Figure 1:
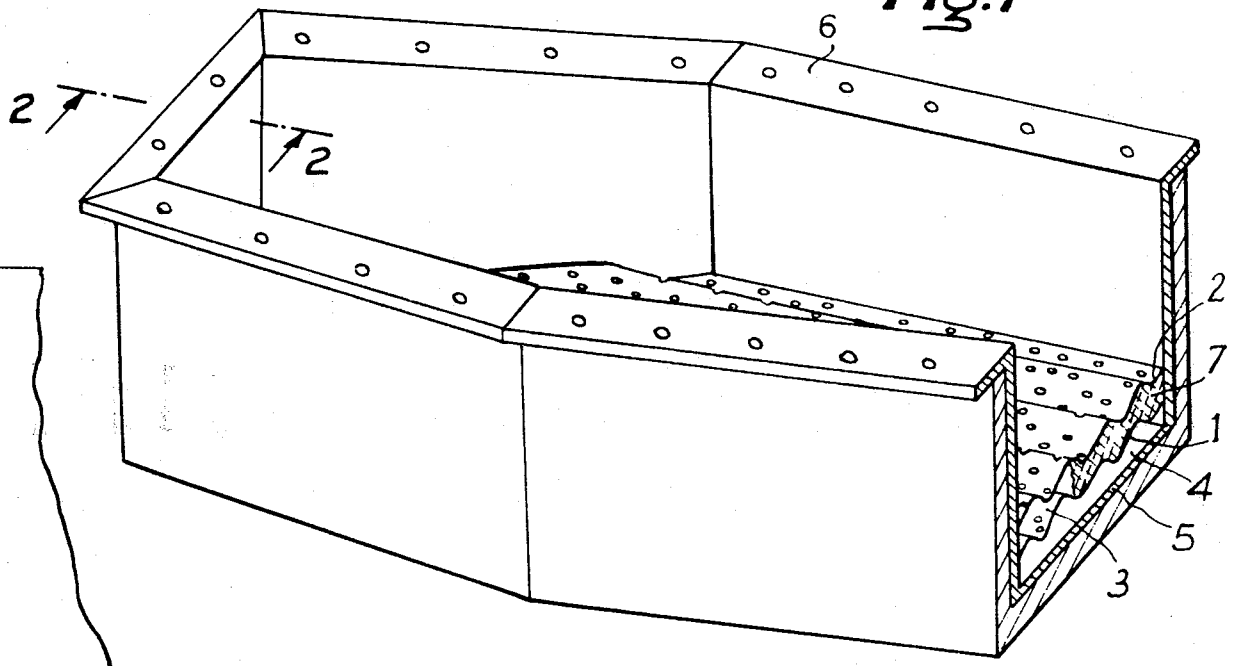

2
7
1
4
5
3
6
2
2

5
8
6
9

COFFIN

The present invention relates to coffins, more particularly of the type to receive an unembalmed body.

In the absence of embalming, physiological liquids soon flow from a corpse. When the coffin is buried, there is no longer a problem, but if the coffin is to be retained in a mausoleum, it is necessary that the niche in which the coffin is placed should be somewhat inclined and that the coffin should have a drain which connects to a drain of the mausoleum. Otherwise, there would be a fermentation of the physiological liquids and an evolution of gas which would raise the pressure in the coffin and leak out.

It is an object of the present invention to overcome these difficulties by means located within the coffin which permit absorbing and neutralizing these liquids and to avoid their escape from the coffin and if desired also to connect with the drain of a mausoleum.

To this end, the coffin according to the present invention is provided with two sheets, preferably corrugated, traversed by holes of any desired diameter, the sheets being disposed parallel to the bottom of the coffin and also being spaced apart from each other and spaced above the bottom of the coffin a short distance so as to create in effect two chambers, one below the sheets and the other between the sheets. The chamber between the sheets is provided with absorbent material such as cellulose wadding, sawdust or the like.

It is another feature of the present invention that there may be added to the absorbent material between the sheets, selective absorbents or adsorbents for the gas such as activated charcoal, and/or for the liquids such as silica gel.

Still another feature of the present invention comprises the positioning in the space below the sheets in the bottom of the coffin, solid bactericidal materials such as those containing permanganate or formaldehyde or solid bactericidal materials which emit bactericidal gases such as bromine, chlorine or iodine upon contact with physiological liquids.

The present invention is applicable to a wide variety of coffins, among them those dealt with in my earlier U.S. Pat. No. 3,525,132, which issued Aug. 25, 1970. Such coffins may be of metal, wood, wood lined with an impermeable material such as plastic material or sheet zinc or partially or entirely of plastic. In the case of coffins lined with a plastic shroud, the preferred method comprises, for burial in the earth, to make the shroud of a self-destructing plastic so as to permit access by biodegradation agents thereby to obtain a natural destruction of the tissues. The coffins according to the present invention, however, are preferably for use in niches in mausolea but may of course also be buried in the ground.

A coffin according to the present invention functions as follows: a short time after the coffin is closed, the physiologic liquids are emitted and pass through the holes of the upper sheet and are absorbed by the material between the sheets. Some liquid may nevertheless traverse this absorbent layer and flow through the holes of the lower sheet to react finally upon contact with the solid bactericidal materials. Thus the formation of fermentation gases is avoided in the interior of the coffin and the leaking of gas as well as the necessity to provide the mausoleum with a complex installation for the evacuation of gases and liquids.

When the coffin is lodged in a mausoleum and health regulations so require, there can be provided in the coffin means for the fluidtight connection of the coffin to conduit means of the mausoleum. In such a case, to satisfy such regulations, the coffin may have a connection for evacuating excess liquid when the provisions of the present invention are insufficient to handle all the liquid. Even so, the liquids leaving the coffin will have first been treated and neutralized by the substances at the bottom of the coffin.

Figure 2:
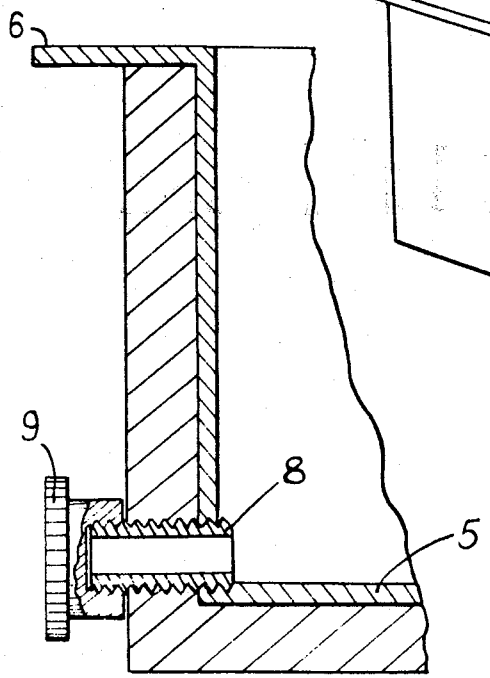

Other objects, features and advantages of the present invention will become apparent from a consideration of the following description, taken in connection with the accompanying drawing, in which:

FIG. 1 is a perspective view of a coffin according to the invention, without a lid, and partially broken away; and FIG. 2 is an enlarged fragmentary cross-sectional view of drain means for the coffin, taken on the line 2—2 of FIG. 1.

Referring now to the drawing in greater detail, there is shown a coffin 6 which of course is destined to be provided with a lid (not shown) and which may be of the type dealt with in my above-identified patent. In the bottom of the coffin are lower and upper sheets 1 and 2, respectively, which are preferably corrugated, and which may for example by of rigid plastic material, traversed by holes of any desired size. The sheets are horizontally disposed parallel to each other and spaced apart a given distance from each other and above the bottom 5 of the coffin 6. In the space 3 between the sheets 1 and 2, there is disposed absorbent material 7 which may for example be cellulose wadding or sawdust or the like, to which may be added substances such as activated charcoal to absorb the gases and/or silica gel to absorb the liquids. The space 4 between the lower sheet 1 and the bottom 5 of the coffin contains solid bactericidal substances (not shown) such as those containing permanganate or formaldehyde or those giving off bromine, chlorine or iodine upon contact with physiological liquids that pass through the absorbent to the bottom of the coffin.

FIG. 2 is an enlarged fragmentary cross-sectional view of the rear wall of the coffin 6. This wall has a screw-threaded hollow male fitting 8 disposed at the same level as the bottom of the coffin and perpendicular to the wall through which it extends, and closed by a removable screw-threaded plug 9.

In operation, which the corpse disposed in the coffin 6 resting on the sheet 2 begins to decompose, the physiologic liquids and gases will pass through the holes in the sheet 2 and will be absorbed by the absorbent material in the space 3. Any excess will pass through the holes in the lower sheet 1 and come into contact with the bactericidal substances disposed in the space 4 and react with the latter. The gases and liquids in question will thus either be absorbed by or neutralized by the materials in the bottom of the coffin between and below the corrugated sheets.

The male fitting 8 may be connected in a fluidtight manner with conduits of a mausoleum for the discharge of liquids, the plug 9 of course being removed for this purpose. To facilitate this, the coffin may be tilted so that the side or end of the coffin in which the fitting 8 is disposed is located lowermost. If the coffin is to be buried in the ground, then the plug 9 can be left in place. In this latter case, if the coffin is of wood lined with plastic material, it is preferred that the plastic material be autodestructible so as to permit biological and biochemical degradation of the corpse.

From a consideration of the foregoing disclosure, therefore, it will be evident that the initially recited object of the present invention has been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

Having described my invention, I claim:

1. A coffin having a bottom and side walls and a pair of rigid corrugated and perforated superposed sheets in the bottom of the coffin parallel to but spaced between said bottom and the lower of said sheets, both said corrugated sheets being substantially parallel to but spaced apart from each other so as to form an intermediate chamber between said sheets, an absorbent material filling said intermediate chamber, and a drain fitting opening at the bottom of the lower chamber.

2. A coffin as claimed in claim 1 and a bactericidal solid material in said lower chamber.

* * * * *